United States Patent [19]

Rheney

[11] Patent Number: 5,000,106

[45] Date of Patent: Mar. 19, 1991

[54] TRANSPARENT BOAT

[76] Inventor: William E. Rheney, 5984 SW. 83 St., Miami, Fla. 33143

[21] Appl. No.: 213,331

[22] Filed: Jun. 30, 1988

[51] Int. Cl.[5] ..... B63B 5/24

[52] U.S. Cl. ..... 114/66; 114/357

[58] Field of Search ..... 114/66, 88, 65 R, 355, 114/356, 357, 358, 360, 347; 441/135; 428/412

[56] References Cited

U.S. PATENT DOCUMENTS

| | | | |
|---|---|---|---|
| 2,980,153 | 4/1961 | Burch | 114/358 X |
| 3,176,055 | 3/1965 | Loos | 114/357 X |
| 3,179,961 | 4/1965 | Ward et al. | 114/356 X |
| 3,190,409 | 6/1965 | Petterson | 114/88 X |
| 3,372,408 | 3/1968 | Luger et al. | 114/357 |
| 4,516,941 | 5/1985 | Reid | 114/347 |
| 4,645,708 | 2/1987 | Le Grand | 428/412 X |
| 4,841,899 | 6/1989 | Fleckles et al. | 114/66 X |

FOREIGN PATENT DOCUMENTS

| | | | |
|---|---|---|---|
| 2111915 | 8/1989 | United Kingdom | 114/347 |

OTHER PUBLICATIONS

"Yachting", vol. 102, No. 5, Nov. 1957, p. 6.

*Primary Examiner*—Sherman Basinger
*Attorney, Agent, or Firm*—Malin, Haley, McHale, DiMaggio & Crosby

[57] ABSTRACT

A "glass boat" is provided including wooden structural members provided with a skin of plastic. The plastic panels are secured to mahogany structural members with stainless steel screws. An outer mahogany strip is applied on top of the screws thereby placing all the edges of the panels between inner and outer mahogany portions. The boat is further provided with foam filled seat compartments to permit the boat to float even when capsized.

14 Claims, 1 Drawing Sheet

TRANSPARENT BOAT

BACKGROUND OF THE INVENTION

In the past years, there have been many attempts to develop an acceptable all glass boat. Although these boats were referred to as "glass boats", they were not made of actual glass. The boats were constructed of wood or aluminum structural members with some form of plastic material used to form the skin of the hull. The plastic bottom and sides were attached to the structural members in some manner in an attempt to make it seaworthy. However, these boats never reached a high degree of success. The main reason for their failure to achieve success in the market place was due primarily to the fact that the boats could never pass U.S. Coast Guard standards, which is a prerequisite to placing the boat for sale. Additionally, the type of plastic which was used discolored after a relatively short period of time in the hot sun. A further problem with those particular types of boats was leaking at the points and attachment to the structural members as well as cracking.

As one can readily imagine, a boat of this type, i.e. "a glass boat", would have considerable appeal to the boating public when used for fishing or just "cruising around" in some clear lake, stream or offshore body of water. Such a boat would be very useful to scuba divers, firemen, police and the like for rescue missions of someone or something lost in a body of water.

SUMMARY OF THE INVENTION

In view of the above facts, applicant was motivated to develop a "glass boat" which is made of wooden structural members and then provided with a skin of LEXAN. Applicant has developed a unique method of attaching the LEXAN skin to the structural members of the boat.

As is well known, LEXAN is a relatively new product of the General Electric Corp. Among the many advantages of LEXAN is the fact that it is many, many times stronger than glass, approximately 250 times stronger. Another advantage is the fact that it retains its clarity and does not discolor, permitting persons in the boat to clearly see through the bottom and hull of the boat.

Applicant has chosen to make all structural members of mahogany to receive the LEXAN panels. After securing the LEXAN panels to the mahogany structural members with stainless steel flat head screws an outer mahogany strip is applied. Thus all edges of the LEXAN portions are "sandwiched" between inner and outer mahogany structural members. Silicone is generously utilized to provide a further measure of sea worthiness and prevent leaks. Due to the use of LEXAN as the material forming the entire skin of the boat the resulting weight of the boat is light enough that it can be readily handled by one person. Additionally, the size of the boat, approximately eight feet in length with a beam of approximately four feet, renders it readily mountable on a car or stationwagon roof.

OBJECTS OF THE INVENTION

An object of the invention is to provide a see-through boat wherein the boat bottom and side planking are made of a tough transparent plastic material.

Another object of the invention is to provide a lightweight, U.S. Coast Guard approved dinghy or punt type boat.

A further object of the invention is to provide a boat wherein all structural members are made of wood and may be sold assembled or in kit form.

A still further object of the invention is to provide a boat with floatation compartments which permits the boat to float even when capsized.

Another object of the invention is to provide a novel method of assembly of the components.

A further object of the invention is to provide interlocking structural members and transparent material secured together by stainless steel screws.

A still further object of the invention is to provide a construction permitting maximum load to length ratio.

A yet further object of the invention is to provide a boat which can be powered by oars or a small rear transom mounted motor.

These and other objects of the invention will become more apparent hereinafter. The invention will now be described with particular reference to the accompanying drawings which form a part of this specification wherein like reference characters designate the corresponding parts in the several views.

DETAILED DESCRIPTION OF THE DRAWINGS

Figure 1:
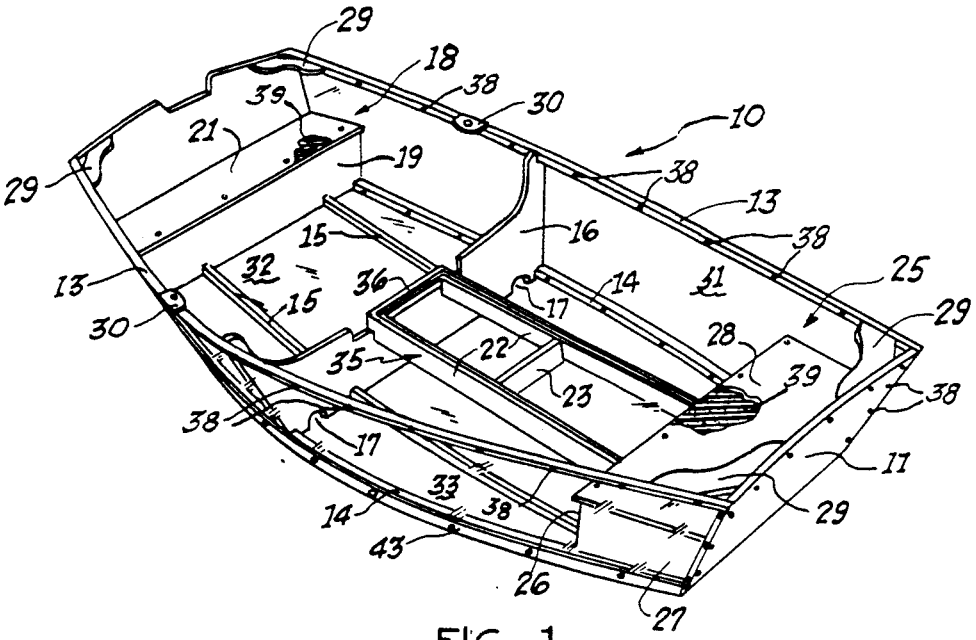
FIG. 1 is a perspective view of the novel transparent boat.

Referring now to FIG. 1, there is shown a perspective view of the novel transparent boat generally indicated by the reference numeral 10. As can be seen from FIG. 1, all structural members are made from mahogany wood. Forward transom or bow 11 is structurally interconnected with rear transom 12 by a pair of gunwales 13 and a pair of lower fore and aft extending chines 14. Between chines 14 and on the same horizontal plane thereof are a pair of fore and aft stringers 15 which extend forward and rearward to the inner faces of bow 11 and rear transom 12. Located midships of boat 10 is mid-frame 16 which is notched at its lower edge to permit stringers 15 to partially enter mid-frame 16 leaving a narrow gap between mid-frame 16 and floor panel 32. Additionally, gunwales 13 are securely attached to the upper outboard edges of mid-frame 16 which is notched whereas chines 14 are secured thereto at the bottom outboard edges. Mid-frame 16 is provided with a further pair of notches or limber holes 17 in the lower face to permit water to flow underneath mid-frame 16 in the event of rain while out on the water or waves splashing over the gunwales 13 when in use. In this regard it is to be noted that the bottom of mid-frame 16 is slightly above floor 32. Immediately forward of rear transom 12 is aft seat 18. Aft seat 18 is formed by transverse member 19 cooperating with a pair of side panels 20 and an overlapping top panel 21 and a bottom (not shown). However, before top panel 21 is secured in place the cubic volume therein is filled with a two-part foam which reacts and then solidifies to form a solid block of foam 39 having a density of 2 lbs./ft3. This foam 39 is non-water absorbing foam 39 and with a similar block of foam in bow seat 25 cooperates to result in a boat having a positive buoyancy, i.e. it will not sink if capsized, it will remain afloat.

Extending forward of mid-frame 16 are a pair of spaced longitudinal members 22 which are securely mounted to transverse panel 26. Longitudinal members 22 are further provided with a pair of supporting cross-members 23 and 24. The top innermost edge of mid-frame 16, longitudinal members 22 and forward cross member 24 is recessed at 36 to receive an appropriately sized sheet of Lexan which provides a smooth seating surface. Bow seat 25 is made in the same manner as stern seat 18. The forward or bow transom 11 serves as the forward support member with side panels 27 and transverse panel 26 and a bottom (not shown) completing the structure. Top panel 28 is secured in place after the cubic volume formed by these members is filled with a two part foam spray which combines and solidifies to form a solid block of foam 39 having a density of two lbs/ft3 identical to that used in aft seat 18. Gunwales 13 are braced to rear transom 12 and bow transom 11 in the corners by brace members 29. All joints of the mahogany structural members and seats are secured with stainless steel screws 38. However, the various members are pilot drilled to prevent cracking or splitting of the mahogany when threading in the stainless steel screws 38.

Gunwales 13 are each provided with a bronze oarlock 30 to receive a pair of oars. With the oarsman (not shown) seated on rowing seat 35 facing aft, the oarsman can place his feet on the Lexan floor 32 in the area between mid-frame 16 and aft seat 18 to assume a comfortable position for rowing.

Having described the wooden structural members of boat 10 the skin or planking is attached to the outside of the various members. Basically, there are four panels of Lexan, each of which has been cut to their exact dimensions through the use of patterns. The first panel comprises floor 32 with a pair of port and starboard side panels 31 and 33, respectively. Side panel 31 is the panel on the port side while side panel 33 is the panel attached to the starboard side of the boat 10. The remaining Lexan panel is rowing seat panel 34 which is received in recess 36 as described above. It is to be noted that during the construction process a plurality of clamps are required to hold the various structural members in their desired position until the insertion of all the stainless steel screws 38 has been completed at which time, the various clamps can be removed with the chines 14, gunwales 13, rear transom 12 and bow 11 all retaining their desired positions including curvature and angular relationships.

It must be remembered that although FIG. 1 appears to be merely the framework of a boat, it is in fact, a completed boat with its bottom panel 32 and side panels 33 and 34 in place ready for use. It is the Lexan skin with its total transparency that gives the illusion that it is merely the frame structure of a boat.

Figure 2:
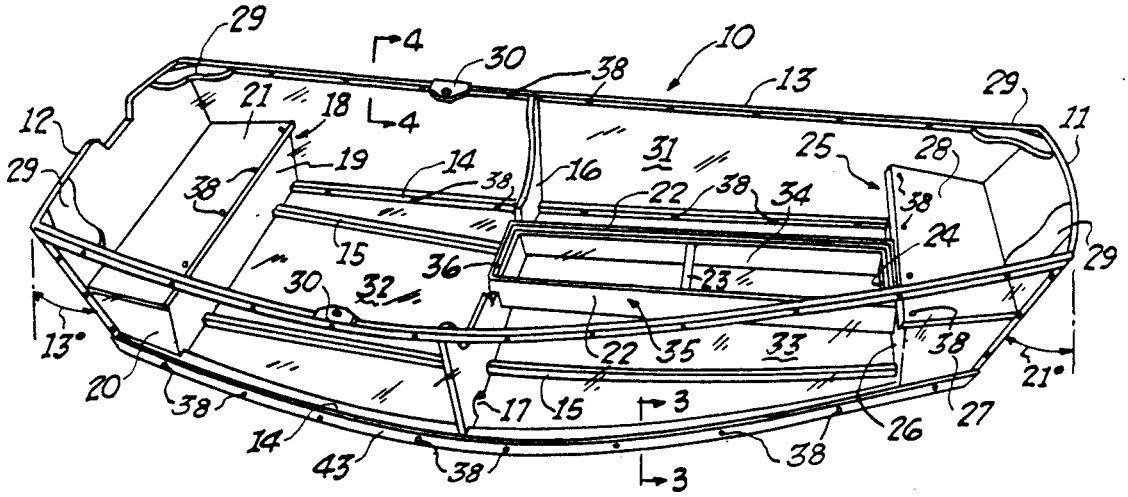
FIG. 2 is another perspective view at a slightly different angle.

Referring now to FIG. 2, there is shown another perspective view of boat 10 at a slightly different angle from that shown in FIG. 1. Both views clearly illustrate the fact that boat 10 is widest at its mid-frame 16, this measurement being approximately four feet. Additional measurements are as follows: chine to chine at stern is approximately twenty-eight inches; gunwale to gunwale at rear transom is approximately thirty-two inches; height at rear transom is approximately seventeen and one-half inches; chine to chine at bow is approximately nineteen inches. Length overall (LOA) is approximately eight feet with its width at mid-frame approximately forty-four inches. Bow to vertical is 21 degrees while rear transom to vertical is 13 degrees.

Figure 3:
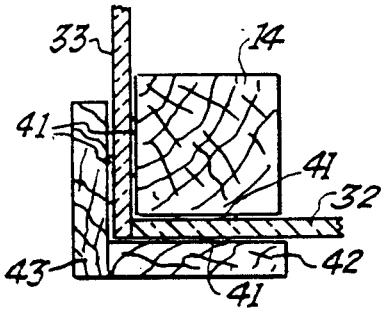
FIG. 3 is a sectional view taken on the plane 3—3 in FIG. 2 illustrating the interfitting of the chine, side and bottom panels of transparent material.

Referring now to FIG. 3, there is shown what is called a three piece chine which comprises a one-inch square mahogany chine member 14 which extends the full length of boat 10 from forward transom 11 to stern transom 12. Secured to the bottom face of chine 14 is bottom panel 32 which terminates at the left vertical side of chine 14. Bottom panel is provided with a bead of Silicone or other appropriate sealant 41 and then secured by stainless steel screws 38 to chine 14. Starboard panel 33 abuts outward face of chine 14 and extends downward to the point where it is flush with the outer surface of bottom panel 32. Here again a bead of sealant 41 is utilized to prevent leakage. Stainless steel screws 38 are screwed through starboard panel 33 into chine 14. To improve the appearance an outer molding strip 42 one and one-quarter inch by one-quarter, also of mahogany, is placed below bottom panel 32, again with a bead of sealant and then fastened to chine 14 by stainless steel screws 38. Starboard panel 33 is similarly capped with another molding strip 43 and a sealant bead 41 between the outer surface of starboard panel 33 and the molding strip 43 and then fastened to chine 14 by stainless steel screws 38. Member 14, strip 42 and strip 43 make up the three pieces from which the name "three-piece chine" is derived. One of the main advantages of the three-piece is the fact that member 14 is only one-inch by one-inch thus permitting it to readily bend to the required curvature during the assembly process without cracking, splitting or breaking.

Figure 4:
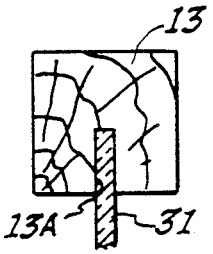
FIG. 4 is a sectional view taken on the plane 4—4 in FIG. 2 illustrating the interfitting of the gunwale and the side panel of transparent material.

Referring now to FIG. 4, there is shown a sectional view taken on the plane 4—4 in FIG. 2. As illustrated, gunwale 13 is formed of a one-inch by one-inch piece of mahogany which extends fore and aft from bow transom 11 to stern transom 12. Gunwale 13 is provided with a one-eighth inch wide channel 13A which receives port panel 31. After port panel 31 is inserted into recess 13A stainless steel screws 38 are inserted from the outside inward into gunwale 13 through port panel 31. As pointed out previously all screw holes are pilot drilled before inserting the stainless steel screws 38 to reduce the possibility of cracking or splitting to a minimum. Additionally the spacing and number stainless steel screws 38 utilized is such to ensure the watertight integrity of the boat.

Although the transparent material has been identified as LEXAN, which is manufactured by General Electric Corp., other suitable materials are presently available with identical characteristics such as high strength, flexibility, non-discoloring and transparency. For example, there are presently available on the open market, a plurality of polycarbonates which possess the above-identified characteristics and could readily be used.

While the invention has been described in its preferred embodiment, it is to be understood that words which have been used are words of description rather than limitation and that changes may be made within the purview of the appended claims without departing from the full scope or spirit of the invention.

Having thus described my invention, I claim:

1. A boat construction comprising in combination: wooden structural member means forming the complete framework of said boat, said wooden structural member means comprising a plurality of spaced apart chines extending in a fore and aft direction; a plurality of stringers positioned inboard of and spaced from said chines on the same horizontal plane thereof; a forward transom positioned at an angle relative to vertical with the forwardmost ends of said chines and stringers attached thereto at the bottom end thereof; a rearward transom positioned at an angle relative to vertical with the rearwardmost ends of said chines and stringers attached thereto at the bottom end thereof; and a port and starboard gunwale extending in a fore and aft direction with the forwardmost ends of said gunwales securely fastened to the respective sides of said forward transom; transparent panels forming the hull of said boat; and attachment means for securing said transparent panels to said wooden structural member means.

2. A boat construction of the character defined in claim 1 wherein said forward transom angle is greater than said rearward transom angle.

3. A boat construction of the character defined in claim 1 wherein said forward transom angle is twenty-one degrees relative to vertical and said rearward transom angle is thirteen degrees relative to vertical.

4. A boat construction of the character described in claim 1 wherein said attachment means comprises a plurality of spaced stainless steel screws which are received in pilot drilled holes in said transparent panels and wooden structural member means to prevent cracking and splitting when inserted therein from the outboard side inward.

5. A boat construction of the character described in claim 4 wherein said attachment means further comprises a bead of sealant in all areas where transparent panels contact said wooden structural member means to maintain the seaworthiness of said boat.

6. A boat construction of the character described in claim 1 further comprising:

seat means supported by said structural member means;

buoyancy means mounted within said boat to provide a positive buoyancy to said boat; and oar lock means mounted on certain structural members whereby oars may be inserted therein to permit rowing of said boat.

7. A boat construction of the character described in claim 6 wherein said seat means comprises a forward and rearward transom seat; each of said forward and rearward transom seats is formed of a transverse panel and two side panels; said two side panels of each seat is attached to its respective forward and rearward transom and stringers; said transverse panels each attached to the side panels of the respective seat and a top panel forming the seating surface attached to said side panels and said transverse panels.

8. A boat construction of the character described in claim 7 wherein said buoyancy means comprises solidified foam which has been injected into the cubic volume formed by said seat panels prior to securement of said top seating panel.

9. A boat combination of the character described in claim 8 wherein said solidified foam has a density of at least two pounds per cubic foot.

10. A boat combination of the character described in claim 1 wherein said transparent panels are made from a plastic material having the characteristics of flexibility, high impact strength, non-discoloring and transparency.

11. A boat combination of the character described in claim 10 wherein said plastic material is a polycarbonate.

12. A kit for constructing a transparent boat comprising: a pair of chine members which serve as the bottom and side fore and aft structural members; a pair of stringers serving as additional floor supports when spaced inboard of said pair of chine members; a forward and a rearward transom for attachment to the respective fore and aft ends of said chines and stringers; a mid-frame member for supporting said boat at its mid-position when secured at its lower end to said chines and stringers; a pair of gunwales for extending fore and aft between said forward transom and said rearward transom and securement thereto; said pair of gunwales also providing support to said mid-frame member when secured thereto; a pair of side seat panels, transverse panel, bottom panel and top panel for forming a seat when secured to said chine members, stringers, gunwales and rear transom; a quantity of foam having a density of at least two pounds per cubic foot for filling the void formed by said panels forming said rearward seat; a second set of seat panels for forming a forward seat when secured to said forward transom and the forward ends of said chines, stringers and gunwales, a like quantity of foam having a density of at least two pounds per cubic foot for filling the void formed by said second set of panels forming said forward seat; a pair of cross-members for providing a rowing seat base when secured at one end to the transverse panel of said forward seat and secured to said mid-frame at their other end; four pre-cut transparent panels, one of which serves as the bottom of the boat when secured to the outboard face of said chines, stringers and transoms; two of said remaining panels serving as the port and starboard panels when secured to said chine and gunwale, respectively; said fourth panel serving as the rowing seat when secured to said cross-members and mid-frame member; a pair of oar locks for attachment to said gunwales to permit insertion of oars therein when said boat is assembled; a quantity of sealant for providing a sealing bead at all points of contact between said structural members and said transparent panels; a plurality of bracing members wherein each of the corners of the boat can be braced; and a plurality of stainless steel screws which serve to secure said structural members together and also said transparent panels when inserted into pre-drilled holes to assemble said boat into a two-man positive buoyancy see-through boat.

13. A kit for constructing a transparent boat as set forth in claim 12 wherein said transparent panels of plastic material have the characteristics of flexibility, high impact strength, non-discoloring and transparency.

14. A kit for constructing a transparent boat as set forth in claim 13 wherein said plastic material is a polycarbonate.

* * * * *